US010029897B2

(12) United States Patent
Guarino et al.

(10) Patent No.: US 10,029,897 B2
(45) Date of Patent: Jul. 24, 2018

(54) CONTROL VALVE AND SYSTEM WITH PRIMARY AND AUXILIARY FUNCTION CONTROL

(71) Applicant: Parker-Hannifin Corporation, Cleveland, OH (US)

(72) Inventors: Joshua Matthew Guarino, Strongsville, OH (US); Brian Bernard Slattery, Hicksville, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 501 days.

(21) Appl. No.: 14/700,868

(22) Filed: Apr. 30, 2015

(65) Prior Publication Data

US 2015/0316079 A1 Nov. 5, 2015

Related U.S. Application Data

(60) Provisional application No. 61/986,176, filed on Apr. 30, 2014.

(51) Int. Cl.

| | |
|---|---|
| ***F15B 11/16*** | (2006.01) |
| ***B66F 9/22*** | (2006.01) |
| ***F15B 13/02*** | (2006.01) |
| ***F15B 21/08*** | (2006.01) |
| ***B66F 11/04*** | (2006.01) |
| ***F15B 13/08*** | (2006.01) |

(52) U.S. Cl.

CPC ..... *B66F 9/22* (2013.01); *B66F 11/044* (2013.01); *F15B 11/162* (2013.01); *F15B 13/022* (2013.01); *F15B 13/0839* (2013.01); *F15B 21/08* (2013.01); *F15B 11/165* (2013.01); *F15B 2211/20538* (2013.01); *F15B 2211/20546* (2013.01); *F15B 2211/30535* (2013.01); *F15B 2211/50536* (2013.01); *F15B 2211/6057* (2013.01); *F15B 2211/781* (2013.01); *Y10T 137/85986* (2015.04)

(58) Field of Classification Search

CPC .... F15B 11/163; F15B 11/162; F15B 13/022; F15B 13/0839; B66F 11/044; B66F 9/22

See application file for complete search history.

(56) References Cited

U.S. PATENT DOCUMENTS

| | | | | |
|---|---|---|---|---|
| 5,992,294 A * | 11/1999 | Seddon | ..... | F15B 13/0402 192/103 F |
| 8,756,930 B2 * | 6/2014 | Johnson | ..... | B62D 5/075 60/430 |
| 2002/0014074 A1 * | 2/2002 | Ehara | ..... | B66C 13/18 60/421 |

* cited by examiner

*Primary Examiner* — F. Daniel Lopez
*Assistant Examiner* — Abiy Teka
(74) *Attorney, Agent, or Firm* — McDonnell Boehnen Hulbert & Berghoff LLP

(57) ABSTRACT

A method of controlling a hydraulic system having a hydraulic lift function and an auxiliary function includes disabling the hydraulic lift function and the auxiliary function by routing pump flow to tank and opening the lift function and auxiliary function to tank with a single valve; enabling the lift function by closing pump flow to the auxiliary function and routing pump flow to the lift function with the single valve; and enabling the auxiliary function by closing pump flow to the lift function and routing pump flow to the auxiliary function with the single valve.

16 Claims, 5 Drawing Sheets

CONTROL VALVE AND SYSTEM WITH PRIMARY AND AUXILIARY FUNCTION CONTROL

RELATED APPLICATIONS

This application claims the benefit of U.S. Provisional Application No. 61/986,176 filed Apr. 30, 2014, which is hereby incorporated herein by reference.

FIELD OF INVENTION

The present invention relates generally to a fluid control valve and to a fluid system, and more particularly to a hydraulic fluid control valve and hydraulic fluid system that include primary function controls and auxiliary function controls.

BACKGROUND

Fluid control valves and systems are used in a wide variety of applications for causing and controlling motion of various components. Hydraulic fluid control valves and systems are used in such applications when relatively large forces are to be transmitted and controlled through such components.

One type of hydraulic fluid system may include a hydraulic pump for providing hydraulic fluid under pressure at a certain maximum rate, primary components that use the hydraulic fluid under pressure to operate primary functions, auxiliary or secondary components that use the hydraulic fluid under pressure to operate auxiliary functions, and a hydraulic fluid control valve that directs the hydraulic fluid under pressure to the primary or auxiliary components at a rate commanded by the operator. In such systems, it is sometimes desirable to inhibit hydraulic fluid flow to the auxiliary components when hydraulic fluid is flowing to the primary components, and/or to inhibit hydraulic fluid flow to the primary components when hydraulic fluid is flowing to the auxiliary components.

SUMMARY OF INVENTION

Preferred embodiments eliminate fluid flow to primary function components when auxiliary function components are actuated, even when the auxiliary function components are in a high pressure condition and the primary function control spool is in an actuated or open position. Preferred embodiments also provide additional features and advantages described below.

According to one aspect of the invention, a sectional fluid control valve system includes a combined inlet and auxiliary work section upstream of the primary work section; the combined work section including a pump inlet, an auxiliary work port, a pump pressure passage, and a valve member intermediate the pump inlet and the auxiliary work port and intermediate the pump inlet and the pump pressure passage; the valve member having a disable position substantially disabling fluid pressure communication from the pump inlet to the auxiliary work port and from the pump inlet to the combined section pump pressure passage; the valve member having a primary enable position closing fluid pressure communication between the pump inlet and the auxiliary work port and opening fluid pressure communication between the pump inlet and the combined section pump pressure passage; and the valve member having an auxiliary enable position closing fluid pressure communication between the pump inlet and the combined section pump pressure passage and opening fluid pressure communication between the pump inlet and the auxiliary work port.

Optionally, the system includes a primary work section. The primary work section includes a pump pressure passage and a primary work port, wherein the combined inlet and auxiliary work section is upstream of the primary work section, wherein the pump pressure passage of the combined inlet and auxiliary work section is in fluid communication with the pump pressure passage of the primary work section.

Optionally, the disable position fluidly connects the auxiliary work port and the combined section pump pressure passage to tank.

Optionally, the primary enable position fluidly connects the auxiliary work port to tank.

Optionally, the auxiliary enable position fluidly connects the combined section pump pressure passage to tank.

Optionally, the disable position fluidly connects the pump inlet to tank.

Optionally, a bypass compensator section is intermediate the combined work section and the primary work section.

Optionally, the primary work section includes a valve member intermediate the pump pressure passage and the primary work port, and a compensator that maintains a substantially fixed pressure drop across the valve member.

Optionally, a primary hydraulic motor is in fluid communication with the primary section work port, an auxiliary hydraulic motor in fluid communication with the combined section work port, and a hydraulic pump having an outlet in fluid communication with the pump inlet port.

Optionally, a vehicle has a prime mover, the prime mover is drivingly connected to the hydraulic pump, the primary hydraulic motor is drivingly connected to a man lift multiple boom mechanism on the vehicle, and the auxiliary hydraulic motor is drivingly connected to a work tool.

Optionally, the combined work section includes a housing, the housing includes a front surface and a top surface and end surfaces, electrical solenoids are connected to one of the end surfaces for moving the valve member between its positions, the pump inlet port is disposed on the top surface, and the auxiliary work port is disposed on the bottom surface and on the front surface.

According to another aspect, a method of controlling a hydraulic system having a hydraulic lift function and an auxiliary function includes disabling the hydraulic lift function and the auxiliary function by routing pump flow to tank and opening the lift function and auxiliary function to tank with a single valve; enabling the lift function by closing pump flow to the auxiliary function and routing pump flow to the lift function with the single valve; and enabling the auxiliary function by closing pump flow to the lift function and routing pump flow to the auxiliary function with the single valve.

Optionally, enabling the lift function includes fluidly connecting the auxiliary function to tank with the single valve.

Optionally, enabling the auxiliary function includes fluidly connecting the lift function to tank with the single valve.

The foregoing and other features of the invention are hereinafter described in greater detail with reference to the accompanying drawings.

DETAILED DESCRIPTION

Figure 1:
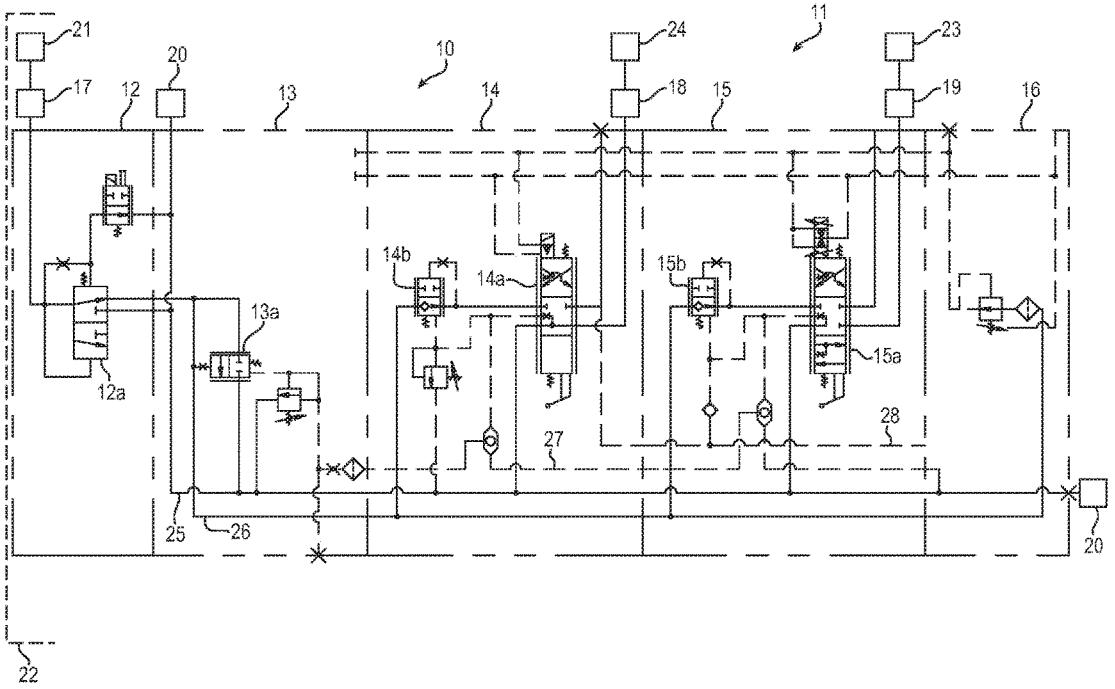
FIG. 1 (Prior Art)
FIG. 1 is a schematic diagram of a hydraulic circuit of a conventional hydraulic fluid control valve and system.

Referring now to the drawings in greater detail, FIG. 1 illustrates a prior art hydraulic valve 10 and a prior art hydraulic system 11. The valve 10 includes an enable inlet section 12, a bypass compensator section 13, an auxiliary or secondary work section 14, a primary work section 15, and an outlet section 16. Additional valve sections (not shown) may also be provided in hydraulic valve 10, such as, for example, additional primary valve work sections (not shown) that will be downstream of section 14 and similar to or identical to valve section 15. The hydraulic system 11 includes the valve 10, a hydraulic pump 17, an auxiliary or secondary function hydraulic motor or cylinder 18, a primary function hydraulic motor or cylinder 19, and a hydraulic tank or reservoir 20.

The valve sections 12-16 of hydraulic valve 10 are each known valve sections which may be, for example, cast and machined metal valve sections that are bolted together to provide a unitary hydraulic valve 10. Each valve section 12-15 includes valve spools and passages shown schematically in FIG. 1. Valve section 16 does not include any valve spools, but does include passages as shown schematically in FIG. 1. The hydraulic pump 17 may be any suitable fixed or variable displacement hydraulic pump and may be, for example, a fixed displacement hydraulic gear pump. Alternatively, the pump 17 may be a variable displacement pump, in which case the bypass compensator valve section 13 would not be provided and load sense signals from valve 10 would control the output displacement of the pump. The pump 17 is driven by a prime mover 21 that may be, for example, an internal combustion engine or electric motor or other prime mover such as, for example, a prime mover disposed on a stationary or movable structure 22. The structure 22 may be, for example, a vehicle, and the prime mover 21 may, for example, propel the vehicle 22 in which the prime mover 21 is mounted. The vehicle 22 may be any suitable land or marine or air or space vehicle, such as, for example, an over the highway truck. The vehicle 22 may include any suitable primary function hydraulic device 23, such as, for example an aerial lift multiple boom mechanism that may be moved vertically or horizontally or rotated by primary hydraulic motor 19. The primary function hydraulic motor 19 may be any suitable hydraulic motor on the vehicle 22, such as, for example, a hydraulic motor that rotates the aerial lift multiple boom mechanism 23. The auxiliary function hydraulic motor 18 may be any suitable hydraulic motor that can be added to the vehicle 22, such as, for example, a hydraulic motor that drives a chain saw or cutter or any other auxiliary or secondary equipment 24 used by the operator of the vehicle 22 when the vehicle 22 is stationary and the operator is in the aerial lift multiple boom mechanism 23. The term "hydraulic motor" means any rotary or linear hydraulic device that is actuated by hydraulic fluid under pressure, such as, for example, a hydraulic cylinder or rotary actuator or gerotor motor or any other hydraulic motor.

Enable inlet valve section 12 includes an enable valve member or spool 12*a* that is movable between a disable position directing fluid flow from pump 17 to tank 20 to preclude actuation of hydraulic motors 18 and 19 when vehicle 22 is being driven and an enable position illustrated in FIG. 1. In the enable position, valve 12*a* directs fluid flow from pump 17 to bypass compensator 13*a* of valve section 13 and to valve sections 14-16. The valve 10 includes an internal tank passage 25, an internal pump pressure passage 26, a primary load sense logic circuit or gallery 27, and a secondary load sense logic circuit or gallery 28. Primary load sense logic circuit 27 communicates the highest load demand pressure in system 11 to bypass compensator 13*a*, which restricts fluid flow from pump 17 to tank passage 25 and causes pump pressure in pump pressure passage 26 to increase to a predetermined differential above such highest load demand pressure in a known manner.

When auxiliary work section valve member or spool 14*a* of auxiliary work section 14 is shifted downward as viewed in FIG. 1 to actuate the auxiliary components including auxiliary hydraulic motor 18 and auxiliary equipment 24, auxiliary hydraulic motor 18 is supplied with hydraulic fluid under pressure from pump pressure passage 26 through auxiliary pre-compensator 14*b* of auxiliary work section 14 to maintain a substantially constant pressure differential across spool 14*a* in a known manner. Hydraulic fluid flows through hydraulic motor 18 to operate auxiliary equipment 24 and is returned to tank 20 through an external connection (not shown).

Auxiliary work section spool 14*a* of auxiliary work section 14 in this position also connects secondary load sense logic circuit 28 to tank 20, and this causes primary work section pre-compensator 15*b* of primary work section 15 to close because there is no or low load sense pressure in secondary load sense circuit 28 biasing pre-compensator 15*b* toward a closed position. By closing pre-compensator 15*b* when auxiliary work section spool 14*a* connects pump pressure to auxiliary hydraulic motor 18, open pressure communication to primary hydraulic motor 19 from pump pressure passage 26 is blocked. In this manner, even if primary work section valve member or spool 15*a* of primary work section 15 is intentionally or unintentionally moved to an open position (which is a downward or upward position from the position viewed in FIG. 1), substantial fluid flow or fluid pressure to primary hydraulic motor 19 is blocked by closed primary work section pre-compensator 15*b*.

Figure 2:
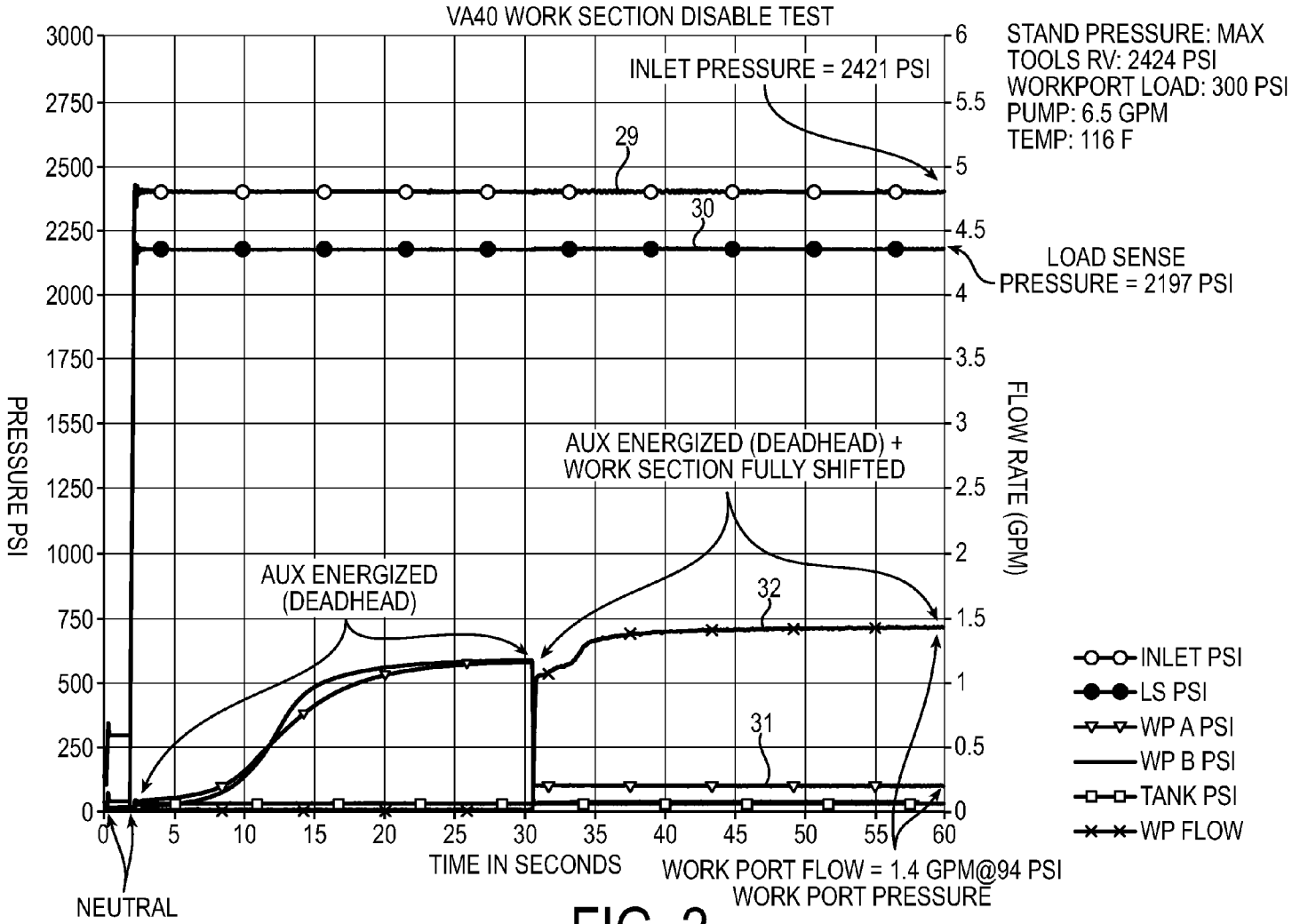
FIG. 2 is a graph illustrating pressures and flow rates at various locations of the valve and system illustrated in FIG. 1 at various times under various conditions.

This operation of prior art valve 10 and system 11 under the condition described above in which secondary or auxiliary work section 14 is actuated by moving spool 14*a* to its actuated position (downward from the position shown in FIG. 1) is illustrated in FIG. 2. When the auxiliary work section 14 is so actuated and the primary work section compensator 15*b* is blocking open fluid pressure communication between the pump pressure passage 26 and primary work section control spool 15*a*, fluid flow is blocked to primary hydraulic motor 19 when primary work section control spool 15*a* is in its de-actuated position shown in FIG. 1. However, if primary work section control spool 15*a* is moved downward or upward from its FIG. 1 de-actuated position to its actuated or open position, under certain conditions a relatively small fluid pressure increase and a relatively small fluid flow rate can be communicated to primary hydraulic motor 19 and cause limited creep of primary hydraulic device 23. This may occur when auxiliary function hydraulic motor 18 is operating at relatively high fluid pressures, such as, for example, under deadhead conditions. This relatively high fluid pressure under this condition exists in pump pressure line 26 on one side (orifice side) of pre-compensator spool 15*b* while low tank pressure exists on the other side (spring side) of pre-compensator spool 15*b*. Under certain conditions when this occurs, pre-compensator spool 15*b* may communicate limited pressure and flow to the actuated (or open) primary control spool 15*a* and to hydraulic motor 19, either by leakage or by oscillation of pre-compensator spool 15*b* or both.

This condition is illustrated in FIG. 2, in which inlet or pump pressure (line 29) is indicated at 2421 pounds per square inch (psi) and load sense pressure (line 30) for auxiliary hydraulic motor 18 is indicated at 2197 psi, which may indicate a deadhead condition for auxiliary hydraulic motor 18. Under this condition, pressure (line 31) communicated to hydraulic motor 19 through work port A of primary work section 15 may be on the order of 94 psi and flow (line 32) may be on the order of 1.4 gallons per minute (gpm), resulting in minimal creep of primary hydraulic device 23 if primary control spool 15*b* is actuated or open at time 31 seconds. If this occurs, the operator can move primary control spool 15*b* to its de-actuated or closed position to eliminate such creep if it is not desired.

The presently preferred embodiment of the present invention, as illustrated in FIGS. 3-6, eliminates the above described fluid flow and minimal creep of primary function hydraulic motor 19 and primary function device 23 under the described conditions when both the auxiliary function work section control spool and the primary function work section control spool are actuated or open, even when the auxiliary hydraulic motor is in a high pressure condition. Further, the present invention combines the enable inlet section with the auxiliary work section to thereby eliminate one section from the prior art valve 10, eliminates the secondary load sense gallery from the prior art valve 10 to eliminate seals and check valves and to eliminate drilling or otherwise machining secondary load sense passages, and maximizes system integration while simplifying the hydraulic circuit.

Figure 3:
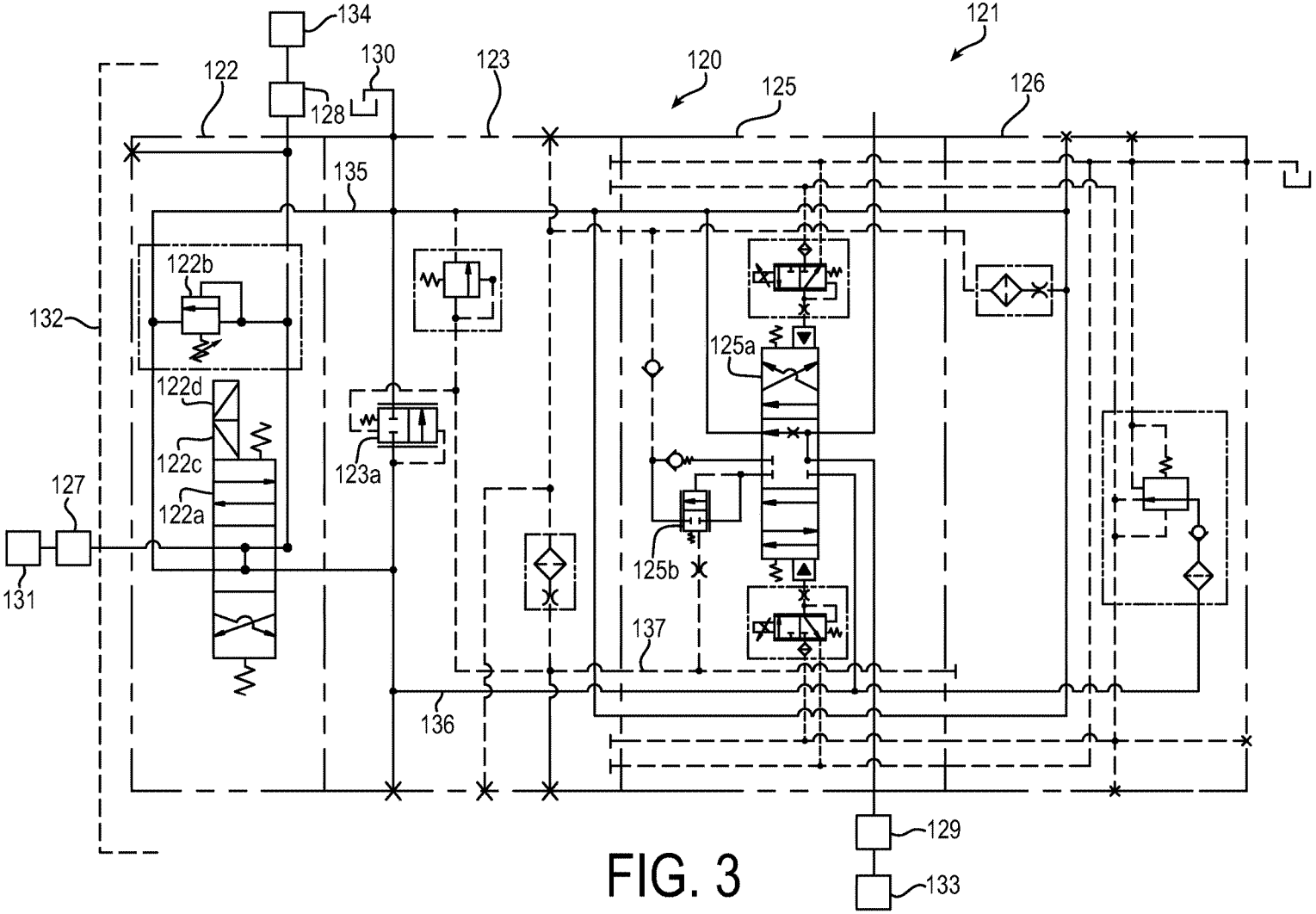
FIG. 3 is a schematic diagram of a hydraulic circuit of an exemplary hydraulic fluid control valve and system.

Turning now to FIG. 3, a hydraulic valve 120 and a hydraulic system 121 according to the preferred embodiment of the invention are illustrated. The valve 120 includes a combined enable inlet and auxiliary work section 122, a bypass compensator section 123, a primary work section 125, and an outlet section 126. Additional valve sections (not shown) may also be provided in hydraulic valve 120, such as, for example, additional primary valve work sections (not shown) that may be downstream of section 125 and similar to or identical to valve section 125. The hydraulic system 121 includes the valve 120, a hydraulic pump 127, an auxiliary or secondary function hydraulic motor or cylinder 128, a primary function hydraulic motor or cylinder 129, and a hydraulic tank or reservoir 130.

The valve sections 122-126 of hydraulic valve 120 each may be, for example, cast and machined metal valve sections that are bolted together to provide a unitary hydraulic valve 120. Each valve section 122-125 includes valve spools and passages shown schematically in FIG. 3. Valve section 126 does not include any valve spools, but does include passages as shown schematically in FIG. 3. The hydraulic pump 127 may be any suitable fixed or variable displacement hydraulic pump and may be, for example, a fixed displacement hydraulic gear pump. Alternatively, the pump 127 may be a variable displacement pump, in which case the bypass compensator valve section 123 would not be provided and load sense signals from valve 120 would control the output displacement of the pump. The pump 127 is driven by a prime mover 131 that may be, for example, an internal combustion engine or electric motor or other prime mover such as, for example, a prime mover disposed on a stationary or movable structure 132. The structure 132 may be, for example, a vehicle, and the prime mover 131 may, for example, propel the vehicle 132 in which the prime mover 131 is mounted. The vehicle 132 may be any suitable land or marine or air or space vehicle, such as, for example, an over the highway truck. The vehicle 132 may include any suitable primary function hydraulic device 133, such as, for example an aerial lift multiple boom mechanism that may be moved vertically or horizontally or rotated by primary hydraulic motor 129. The primary hydraulic motor 129 may be any suitable hydraulic motor on the vehicle 132, such as, for example, a hydraulic motor that rotates the aerial lift multiple boom mechanism 133. The auxiliary hydraulic motor 128 may be any suitable hydraulic motor on the vehicle 132, such as, for example, a hydraulic motor that drives a chain saw or cutter or other auxiliary or secondary equipment 134 used by the operator of the vehicle 132 when the vehicle 132 is stationary and the operator is in the aerial lift multiple boom mechanism 133. The term "hydraulic motor" means any rotary or linear hydraulic device that is actuated by hydraulic fluid under pressure, such as, for example, a hydraulic cylinder or rotary actuator or gerotor motor or other hydraulic motor.

Combined valve section 122 includes a three position four way solenoid valve member or spool 122*a* that is movable between a center disable position illustrated in FIG. 3 connecting auxiliary hydraulic motor 128 and primary hydraulic motor 129 to tank 130, an upward or first or primary function enable position directing fluid flow from pump 127 to pump pressure passage 136 and primary hydraulic motor 129 while connecting auxiliary hydraulic motor 128 to tank 130, and a downward or second or auxiliary function enable position directing fluid flow from pump 127 to auxiliary hydraulic motor 128 while connecting pump pressure passage 136 and primary hydraulic motor 129 to tank 130. The valve 120 includes an internal tank passage 135, an internal pump pressure passage 136, and a primary load sense logic circuit or gallery 137. Primary load sense logic circuit 137 communicates the highest load demand pressure in system 121 to bypass compensator 123*a*, which restricts fluid flow from pump 127 to tank passage 135 and causes pump pressure in pump pressure passage 136 to increase to a predetermined differential above such highest load demand pressure when valve 122*a* is in its above described first or primary enable position. Because the combined valve 122*a* connects the auxiliary hydraulic motor 128 to tank 130 when the primary work section 125 and primary hydraulic motor 129 are enabled, pressure and flow from pump 127 to the auxiliary hydraulic motor 128 is limited to leakage under this condition. Similarly, because the combined valve 122*a* connects the primary hydraulic motor 129 to tank 130 when the auxiliary hydraulic motor 128 is enabled, pressure or flow to the primary hydraulic motor 129 is limited to leakage under this condition even when the auxiliary hydraulic motor 128 is at a high pressure condition such as a deadhead condition.

Figure 4:
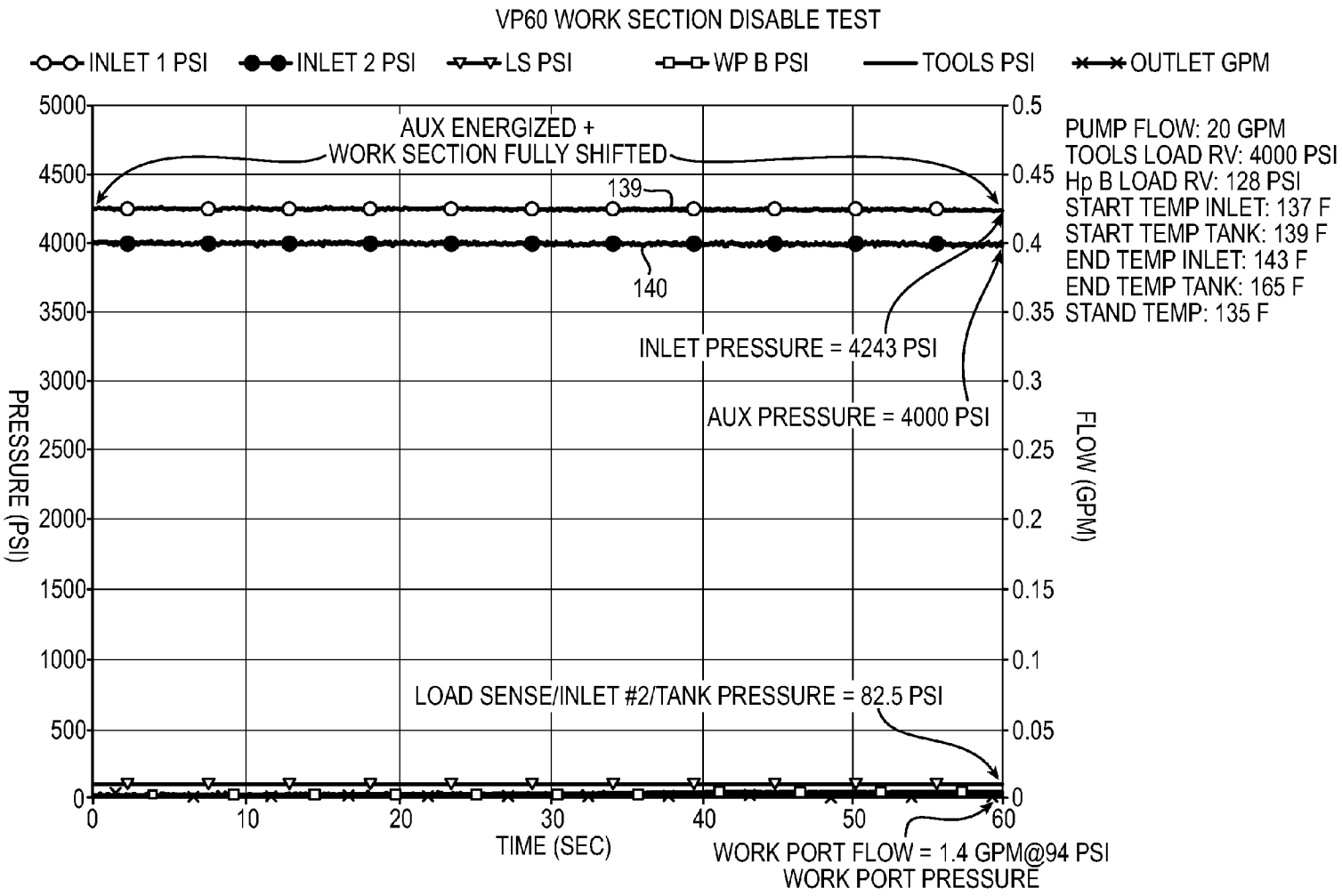
FIG. 4 is a graph illustrating pressures and flow rates at various locations of the valve and system illustrated in FIG. 3 at various times under various conditions.

This operation of valve 120 and system 121 under the auxiliary enable condition described above in which the combined valve spool 122*a* is in its auxiliary enable (or downward from the position viewed in FIG. 3) position and primary work section 125 valve member or spool 125*a* is actuated is illustrated in FIG. 4. Inlet or pump pressure (line 139) is indicated at 4243 pounds per square inch (psi), and auxiliary hydraulic motor 128 pressure (line 140) for auxiliary hydraulic motor 128 is indicated at 4000 psi, which may indicate a deadhead condition for auxiliary hydraulic motor 128. Under this condition, measured pressure at the work port of primary work section 125 was on the order of 27 psi and measured flow was on the order of 0.0 (gpm), resulting in zero creep of primary hydraulic motor 129 and primary hydraulic device 133. The hydraulic valve 120 is a substantially different size than the valve 10 described above, and comparisons of the graphs of FIGS. 2 and 4 should take such differences in the valves 10 and 120 into account.

Figure 5:
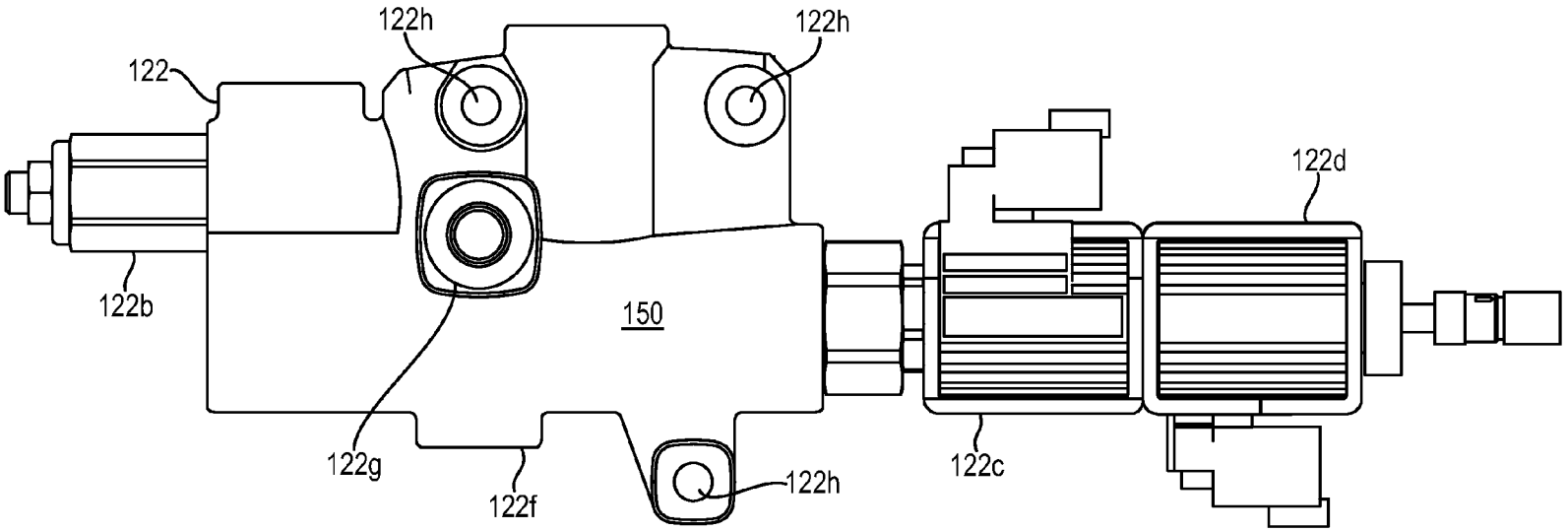
FIG. 5 is a front view of an exemplary combined inlet enable and auxiliary work section of an exemplary hydraulic fluid control valve.
Figure 6:
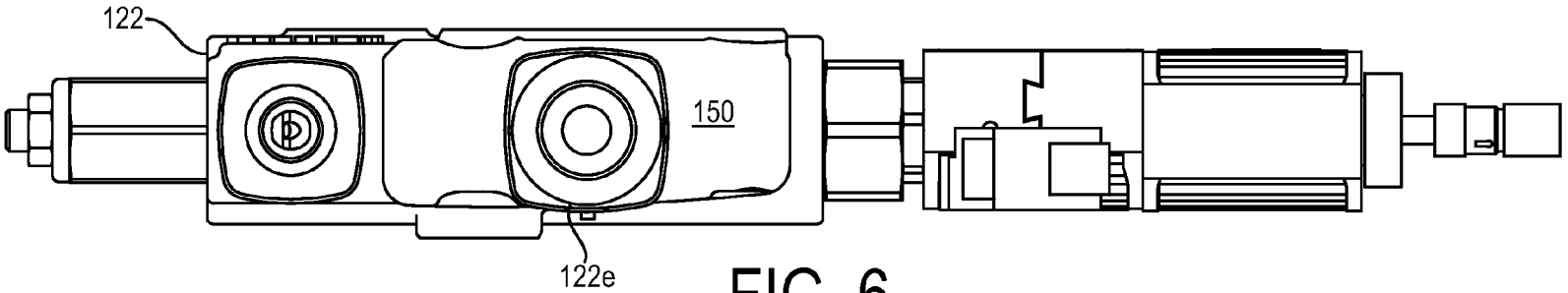
FIG. 6 is a top view of an exemplary combined inlet enable and auxiliary work section of an exemplary hydraulic fluid control valve illustrated in FIG. 3.

Referring now to FIGS. 5 and 6, the housing 150 for the three position four way combined inlet enable and auxiliary work section 122 of valve 120 is illustrated. Solenoid operators 122*c* and 122*d* extend from one side surface of housing 150 and are aligned with one another and with spool 122*a* of section 122. Auxiliary function relief valve 122*b* extends from an opposite side surface of housing 150 and has its spool in parallel alignment with solenoid operators 122*c* and 122*d* and with spool 122*a*. Pump inlet port 122*e* extends from the top of housing 150. Auxiliary ports 122*f* and 122*g* extend from the bottom surface and front surface, respectively, of the housing 150. Tie rod holes 122*h* extend between the front and back sides of the housing 150, and tie rods (not shown) hold the sections of valve 120 together.

There are various benefits of the preferred embodiment of this invention with respect to the prior art solution. One benefit is that this invention simplifies the hydraulic sectional main control valve. It does this by eliminating one of the sections in the hydraulic sectional main control valve and eliminating one check valve cartridge per work section in the valve bank. The prior art solution shows the auxiliary function as the first work section in the hydraulic sectional main control valve, whereas the preferred embodiment has the auxiliary function integrated into the enable inlet. Regardless of which solution is chosen, the hydraulic sectional main control valve must have an enable inlet, so by integrating the auxiliary function into the enable inlet one work section can be eliminated from the hydraulic sectional main control valve. The check valve cartridges purpose is to inhibit any communication of high pressure oil from the auxiliary function in the form of leakage into the "B" work port, into the section compensator spool of a given downstream work section. Since we are eliminating the auxiliary function work section this check valve cartridge becomes unnecessary.

Another benefit is that the preferred embodiment performs the disable feature, better than the prior art solution. The prior art solution performs this feature by diverting the load sense pressure from all of the downstream work sections to the internal tank circuit within the hydraulic sectional main control valve, whenever the auxiliary function is actuated. The reason that this solution works most of the time, is because flow to the work port is developed by the spring setting in the section compensator. Load sense pressure is essentially a hydraulic signal of pressurized oil transmitted from the work port to various parts of the hydraulic sectional main control valve. Load sense pressure in all work sections gets transmitted to the load sense signal gallery and to the section compensator spring chamber whenever a work section is activated. In every work section there is a shuttle valve (two way check valve) which compares the load sense pressure from a specific work section to the load sense pressure that is already in the load sense signal gallery. The series of shuttle valves will transmit the load sense pressure from the highest loaded work section to the load sense relief valve and to the margin pressure control device, which can either be a variable displacement load sensing pump or a bypass compensator. The margin pressure is the pressure at the outlet of the pump minus the load sense pressure being sent from the hydraulic sectional main control valve. The margin pressure is the differential pressure that is available to do work across the hydraulic circuit. When a work section is activated pressurized oil from the inlet will flow to the section compensator. There will be a differential pressure that develops across the ends of the section compensator spool and is used to position the section compensator spool. This differential pressure is the pressure upstream of the main control spool minus the quantity of load sense pressure for that specific work section plus the section compensator spring setting (upstream work section pressure−(LS pressure+compensator spring pressure)). The section compensator spool adjusts its position to obtain a force balance between these pressures. It will open further or close further to modify the pressure coming into it from the inlet to set the pressure upstream of the main control spool, to equal the load sense pressure plus the section compensator spring pressure. So the pressure downstream of the main control spool equals the load sense pressure and the pressure upstream of the main control spool equals load sense pressure plus the section compensator spring pressure. Thus the section compensator spring establishes the differential pressure across the main control spool. The differential pressure across the main control spool along with the area opening of the main control spool contribute in developing the flow rate that gets transmitted to the work port, per the Bernoulli Equation. If the load sense pressure that is transmitted to the load sense signal gallery and to the section compensator spring chamber is also connected to the internal tank circuit then the differential pressure across the main control spool is greatly reduced. In most cases the differential pressure is negative which means that no flow will be transmitted to the work port. However if the pressure required to get an implement to move, is close to the pressure in the internal tank circuit then there can be a positive differential pressure across the main control spool hence, flow going to the work port. This scenario has been seen and validated in a laboratory environment, on a piece of equipment, and illustrated in the drawings.

The preferred embodiment performs this feature by isolating the auxiliary function from the rest of the hydraulic sectional main control valve functions. The auxiliary function is actuated by diverting all pump flow to the auxiliary function, via the three position four way solenoid valve in the enable inlet. When all of the pump flow is going to the auxiliary function, the rest of the functions in the hydraulic sectional main control valve are connected to the internal tank circuit. Since the entire hydraulic sectional main control valve is at the same pressure via the internal tank circuit, there isn't a differential pressure available to create a potential for flow to the work port, even if a work section is actuated.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A sectional fluid control valve system comprising:

a combined inlet and auxiliary section upstream of a primary work section;

the combined inlet and auxiliary section including a pump inlet, an auxiliary work port, a combined section pump pressure passage, and a valve member, the valve member being intermediate the pump inlet and the auxiliary work port, and the valve member being intermediate the pump inlet and the combined section pump pressure passage;

wherein the valve member has a disable position configured to both: (i) disable fluid pressure communication from the pump inlet to the auxiliary work port, and (ii) disable fluid pressure communication from the pump inlet to the combined section pump pressure passage;

wherein the valve member has a primary enable position configured to both: (i) close fluid pressure communication between the pump inlet and the auxiliary work port, and (ii) open fluid pressure communication between the pump inlet and the combined section pump pressure passage; and wherein the valve member has an auxiliary enable position configured to both: (i) close fluid pressure communication between the pump inlet and the combined section pump pressure passage, and (ii) open fluid pressure communication between the pump inlet and the auxiliary work port.

2. The system as set forth in claim 1, wherein the primary work section includes a primary section pump pressure passage and a primary work port, and wherein the combined section pump pressure passage is in fluid communication with the primary section pump pressure passage.

3. The system as set forth claim 1, wherein the disable position fluidly connects the auxiliary work port and the combined section pump pressure passage to tank.

4. The system as set forth in claim 1, wherein the primary enable position fluidly connects the auxiliary work port to tank.

5. The system as set forth in claim 1, wherein the auxiliary enable position fluidly connects the combined section pump pressure passage to tank.

6. The system as set forth in claim 1, wherein the disable position fluidly connects the pump inlet to tank.

7. The system as set forth in claim 1, including a bypass compensator section intermediate the combined inlet and auxiliary section and the primary work section.

8. The system as set forth in claim 1, wherein the primary work section includes a valve member intermediate the primary section pump pressure passage and the primary work port, and a compensator that maintains a fixed pressure drop across the valve member.

9. The system as set forth in claim 1 in combination with a primary hydraulic motor, an auxiliary hydraulic motor, and a hydraulic pump, wherein the primary work port is in fluid communication with the primary hydraulic motor, wherein the auxiliary work port is in fluid communication with the auxiliary hydraulic motor, and wherein the pump inlet of the combined inlet and auxiliary section is in fluid communication with an outlet of the hydraulic pump.

10. The system as set forth in claim 9 in combination with a vehicle having a prime mover, drivingly connected to the hydraulic pump, wherein the primary hydraulic motor is drivingly connected to a man lift multiple boom mechanism on the vehicle, and the auxiliary hydraulic motor is drivingly connected to a work tool.

11. The system as set forth in claim 1, wherein the combined inlet and auxiliary section includes a housing, the housing includes a front surface, a top surface and end surfaces, wherein electrical solenoids are connected to one of the end surfaces for moving the valve member between the disable, primary enable, and auxiliary enable positions, the pump inlet port is disposed on the top surface, and wherein the auxiliary work port is disposed on the front surface.

12. The system as set forth in claim 1, wherein the sectional fluid control valve system includes a plurality of valve sections, each valve section having a housing, the respective housings being mounted together;

wherein the combined inlet and auxiliary section is one valve section of the plurality of valve sections having a first housing, and the primary work section is another valve section of the plurality of valve sections having a second housing, the first housing of the combined inlet and auxiliary section being mounted upstream of the second housing of the primary work section; and wherein the valve member of the combined inlet and auxiliary section is a valve spool movable in the first housing of the combined inlet and auxiliary section between the disable, primary enable, and auxiliary enable positions to fluidly connect one or more fluid passages in the first housing, the first housing having the pump inlet for fluidly connecting to an outlet of a hydraulic pump, and the auxiliary work port for fluidly connecting to an auxiliary function.

13. The system as set forth in claim 1, wherein the auxiliary work port is configured to supply fluid pressure for an auxiliary function, and the combined section pump pressure passage is configured to supply fluid pressure downstream to the primary work section for a primary function;

wherein the disable position is configured to fluidly connect fluid flow entering through the pump inlet to tank, and is configured to fluidly connect the auxiliary work port and the combined section pump pressure passage to tank, thereby minimizing fluid pressure at both the auxiliary work port and the combined section pump pressure passage for disabling both the auxiliary function and the primary function;

wherein the primary enable position is configured to fluidly connect fluid flow entering through the pump inlet to the combined section pump pressure passage to supply fluid pressure to the primary work section for enabling the primary function, and is configured to fluidly connect the auxiliary work port to tank to minimize fluid pressure at the auxiliary work port for disabling the auxiliary function; and wherein the auxiliary enable position is configured to fluidly connect fluid flow entering through the pump inlet to the auxiliary work port to supply fluid pressure for enabling the auxiliary function, and is configured to fluidly connect the combined section pump pressure passage to tank to minimize fluid pressure to the combined section pump pressure passage for disabling the primary function.

14. A method of controlling a hydraulic system having a hydraulic lift function and an auxiliary function, the method comprising:

disabling the hydraulic lift function and the auxiliary function by routing pump flow to tank and opening the lift function and auxiliary function to tank with a single valve;

enabling the lift function by closing pump flow to the auxiliary function and routing pump flow to the lift function with the single valve; and enabling the auxiliary function by closing pump flow to the lift function and routing pump flow to the auxiliary function with the single valve.

15. The method as set forth in claim 14, wherein enabling the lift function includes fluidly connecting the auxiliary function to tank with the single valve.

16. The system as set forth in claim 14, wherein enabling the auxiliary function includes fluidly connecting the lift function to tank with the single valve.

* * * * *